US005767432A

United States Patent [19]

Randolph

[11] Patent Number: 5,767,432

[45] Date of Patent: Jun. 16, 1998

[54] INTERCHANGEABLE CASSETTE FOR STRINGED INSTRUMENTS

[75] Inventor: James B. Randolph, Inkster, Mich.

[73] Assignee: World Class Ramtrak LLC, Redford, Mich.

[21] Appl. No.: 676,674

[22] Filed: Jul. 10, 1996

[51] Int. Cl.[6] ..... G10D 1/08; G10H 3/18

[52] U.S. Cl. ..... 84/743; 84/267

[58] Field of Search ..... 84/723–743, 267

[56] References Cited

U.S. PATENT DOCUMENTS

| | | | |
|---|---|---|---|
| 263,601 | 3/1882 | Klein | D17/18 |
| 2,103,675 | 12/1937 | Johannessen . | |
| 2,786,382 | 3/1957 | Melita . | |
| 4,151,776 | 5/1979 | Stich | 84/1.16 |
| 4,351,216 | 9/1982 | Hamm | 84/1.15 |
| 4,357,852 | 11/1982 | Suenaga | 84/1.16 |
| 4,359,923 | 11/1982 | Brunet | 84/267 |
| 4,377,101 | 3/1983 | Santucci | 84/1.16 |
| 4,425,831 | 1/1984 | Lipman | 84/1.16 |
| 4,428,268 | 1/1984 | Ingoglia | 84/1.16 |
| 4,429,314 | 1/1984 | Albright | 343/788 |
| 4,433,603 | 2/1984 | Siminoff | 84/1.16 |
| 4,442,749 | 4/1984 | DiMarzio et al. | 84/1.15 |
| 4,464,967 | 8/1984 | Trimborn | 84/1.16 |
| 4,501,186 | 2/1985 | Ikuma | 84/1.16 |
| 4,602,547 | 7/1986 | Nyack, Jr. et al. | 84/1.15 |
| 4,616,548 | 10/1986 | Anderson | 84/1.16 |
| 4,632,003 | 12/1986 | Kopp | 84/1.16 |
| 4,643,070 | 2/1987 | Petrillo | 84/313 |
| 5,131,307 | 7/1992 | Castillo | 84/267 |
| 5,398,581 | 3/1995 | Castillo | 84/267 X |

FOREIGN PATENT DOCUMENTS 2599881 12/1986 France .

*Primary Examiner*—Stanley J. Witkowski
*Attorney, Agent, or Firm*—Kohn & Associates

[57] ABSTRACT

A pickup cassette (10) for housing at least one pickup (90) to be utilized with stringed musical instruments (12), such as solid body electric guitars, is disclosed. The pickup cassette (10) may be removably secured in a cavity formed in the stringed musical instrument (12) beneath the strings by a retainer member (40) defining a track which engages a pair of runners (60) on the frame of the pickup cassette. Thus, a pickup cassette (10) designed for picking up a specific type of music, such as rock, may be removed and replaced by a different cassette designed for use when playing, for example, jazz. This arrangement permits the utilization of one musical instrument for playing a variety of types of music by simply removing and replacing any of several different pickup cassettes.

24 Claims, 2 Drawing Sheets

INTERCHANGEABLE CASSETTE FOR STRINGED INSTRUMENTS

BACKGROUND OF THE INVENTION

1. Technical Field

The present invention relates generally to stringed musical instruments, such as electric guitars. In particular, the invention related to a cassette for housing the pickups for such instruments, one aspect of which is that the cassette permits the rapid changing of pickups to play a variety of music.

2. Background Art

Stringed musical instruments, like electric guitars, are usually provided with ferromagnetic strings maintained under tension, such as those disclosed, for example, in U.S. Pat. Nos. 4,616,548 (Anderson), 4,602,547 (Nyack, Jr. et al.), 4,464,967 (Trimborn), 4,377,101 (Santucci) and 4,359,923 (Brunet). Thus, it is known to provide magnetic pickups beneath the strings in the bodies of such guitars, which detect the movement of the metal strings. The pickups generally include wire coils associated with a permanent magnet which creates a magnetic field. The movement of the ferromagnetic strings modulates the magnetic field, thereby generating electrical signal currents in the wire coils, as disclosed, for example, in U.S. Pat. Nos. 4,616,548 (Anderson) and 4,602,547 (Nyack, Jr. et al.). The electrical signal currents may be amplified by an amplifier and transferred to loud speakers as disclosed in U.S. Pat. No. 4,464,967 (Trimbom). However, several limitations have been associated with such arrangements, most significant of which prior hereto, is due to the fact that the pickups have to be mounted into the instruments as disclosed in U.S. Pat. Nos. 4,643,070 (Petrillo), 4,377,101 (Santucci) and 4,359,923 (Brunet). This limitation is compounded by the fact that the pickups are only capable of detecting a limited range of movement or vibration of the strings. Although, pickups are available to detect a limited range of movement, double or single coil pickups are the most common and are specifically designed, for example, to pick up rock, jazz, blues or classical music. This limits the variability of the instrument because the pickups cannot be changed when they are mounted permanently in the instruments which would require changing the openings, resoldering and sometimes rerouting the wiring of the instrument, all of which are time consuming and may damage the instrument.

The pickups in certain situations can be changed, but this is usually not practical because it requires removing the strings in order to gain access to the pickups. Thus, for example, if a musician wants to go from playing rock to blues, the instrument has to be changed. This, besides requiring multiple instruments, is particularly important in situations where the musician has a favorite instrument.

SUMMARY OF THE INVENTION AND ADVANTAGES

In contrast to the above discussed arrangements, the pickup cassette of the present invention permits the pickup for stringed musical instrument to be easily and quickly changed to meet the requirements associated with rock, jazz, blues, etc., in the middle of or between performances, if desired. This permits the musician to play a wide range of music with only one instrument. In addition, a pickup cassette of the present invention can be utilized with a variety of stringed musical instruments for playing one type of music. Furthermore, the pickup cassette can be used to house other effect generating devices such as amplifiers, sequencers, MIDI-computers, etc.

The pickup cassette of the present invention is adapted for housing at least one pickup, and is insertable into a cavity formed in a stringed musical instrument beneath a plurality of strings running along the longitudinal axis of the instrument, and includes a frame or body portion configured to be received within the cavity. The frame or body portion has a top cover which also serves to close the cavity of the musical instrument. The top cover also includes at least one opening for exposing the magnetic field produced by the magnetic pickup to the strings. When the strings vibrate, they accomplish a modulation of the magnetic field produced by the magnetic pickup, whereby a signal current is induced in the wire coils of the magnetic pickup, which is then amplified and supplied to loud speakers. A retaining member releasably retains the pickup cassette in the cavity, and positions the magnetic pickup beneath the strings. Thus, the pickup cassette may be removably inserted into the cavity and the magnetic pickup may be properly positioned beneath the strings. Additionally, the pickups can include optical or sound sensing pickups.

In the preferred embodiment, the retaining member is adapted to engage a pair of runners, one runner extending along and protruding laterally from each side of the frame of the pickup cassette. Further, the retaining member includes a pair of bent sides or flanges disposed at an acute angle to the base of the retaining member for accommodating the runners, whereby the runners may be slid along the bent sides or flanges to releasably retain the pickup cassette within the cavity.

In the disclosed embodiment of the present invention, the pickup cassette further includes a lid attachable to the flame thereof. Also, the flame of the pickup cartridge includes a front wall formed to conform to the contours of the side of the stringed musical instrument. Further, the top of the frame may include a thumb grip secured thereto.

Additionally, the pickup cassette includes electrical mating means associated with the frame thereof for electrically connecting the pickup with the stringed musical instrument when the pickup cassette is releasably inserted into the cavity. In the preferred embodiment, the electrical mating means is adapted to include a pair of female jacks protruding from the frame in order that, when the pickup cassette is inserted into the cavity, the female jacks electrically connect with a pair of male plugs mounted on the retaining member which is mounted in the cavity formed in the body of the stringed musical instrument. Further, at least one switch is interconnected with the pickup for performing a variety of functions in order to mix the output to obtain a desired quality of sound.

BRIEF DESCRIPTION OF THE DRAWINGS

Other advantages of the present invention will be readily appreciated as the same becomes better understood by reference to the following detailed description when considered in connection with the accompanying drawings, wherein.

DETAILED DESCRIPTION OF THE PREFERRED EMBODIMENT

Figure 1:
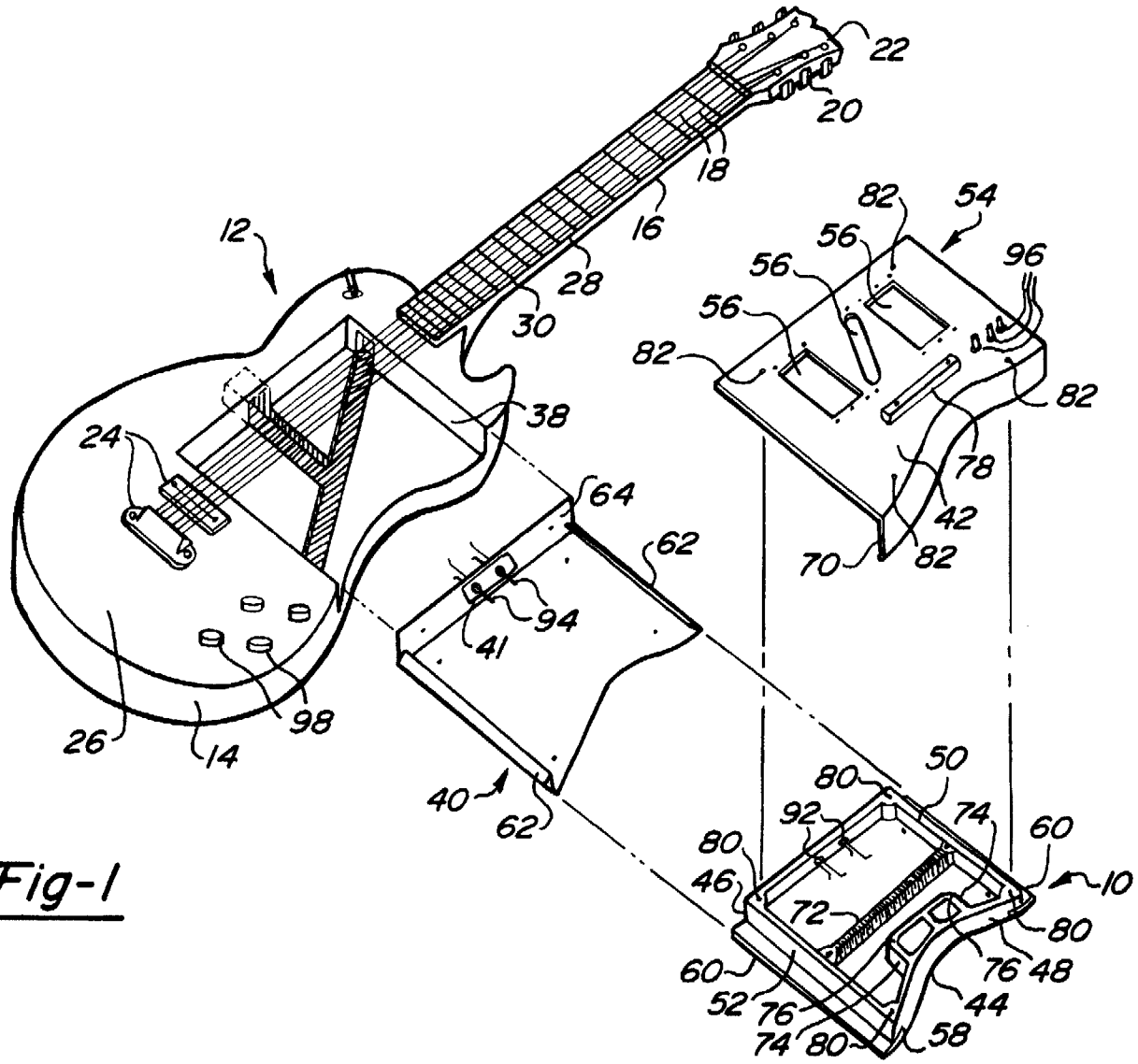
FIG. 1 is an exploded, perspective view of a stringed musical instrument (12) utilizing a pickup cassette (10) of the present invention.

Referring to FIG. 1, the cassette of the present invention, generally designated 10, is illustrated in association with a stringed musical instrument 12. The particular stringed musical instrument is not essential to the present invention and may include, for example, any of the stringed musical instruments of the art mentioned above, preferably solid-body electric guitars. Such an instrument typically includes a body 14 and at least one neck 16, as illustrated in U.S. Pat. Nos. 4,464,967 (Trimborn), 4,377,101 (Santucci), 4,359,923 (Brunet) and Des. 263,601 (Klein), the disclosures of which are hereby incorporated by reference. A plurality of strings 18 generally formed of a ferromagnetic material run along the neck 16 and the body portion 14 parallel to the longitudinal axis of the instrument, and maintained under tension. The strings 18 are each connected at one end to anchoring pins mounted on the body 14 and at the other end to tuning pegs 20 mounted on the neck 16. It should also be appreciated that strings of cat gut, and plastics such as nylon, may be used if they are provided with a winding of fine wire formed of a ferromagnetic material or without the wire winding if optical, sound, or vibrational sensing pickups are used. In the illustrated embodiment, the tuning pegs 20 are connected to the neck 16 at one end by a tuning machine 22. A saddle and bridge combination 24 is mounted on the top 26 of the body 14 perpendicular to the longitudinal axis of the instrument, the saddle having pins to which one end of each of the strings 18 are connected. This may also be accomplished by any of the means known within the art including, for example, that disclosed in U.S. Pat. No. 4,643,070 (Petrillo), the disclosure of which is hereby incorporated by reference. A finger board 28 is mounted on the neck 16 and extends longitudinally along the instrument. The finger board 28 can include frets 30.

A cavity 38 is formed in the body 14 of the instrument 12 in which the pickup cassette 10 may be received and secured by a retaining member 40 which is affixed within the cavity 38. The cassette 10 has a top cover 42, a bottom 44, a back wall 46, a front wall 48 and two sides 50,52. In the preferred embodiment, the top cover 42 is dimensioned and contoured to serve as a removable lid 54 for closing the cavity 38. At least one opening 66 is formed in the lid 54, and the pickup cassette 10 also includes a bottom portion or frame 58. The opening 56 is so dimensioned and positioned as to accommodate many configurations of pre-existing, standard size pickups or any other type of device which may be used to pick up the information provided by the strings 18, i.e., digital or analogue.

A retaining member 40 is provided for securing the frame 58 of the cassette 10 in the cavity 38. A pair of runners 60 can be attached along or protrude from the sides 52 of the body portion or frame 58 or integrally formed in a single molding operation. The retaining member 40 may be formed of, for example, heavy-gage sheet metal or molded plastic with converging side bends or flanges 62 disposed at an acute angle and preferably 45° respect to the base of the retaining member 40 to form a track for slidably engaging the runners 60. A back wall 64 can be provided by bending a flange of the retaining member 40 at a 90° angle. The side bends 62 are spaced apart slightly wider than the width of the runners 60 so that the runners 60 may slide between them with retentive, snug fit in a direction perpendicular to the longitudinal axis of the instrument. The back wall 64 may serve as a back stop for the frame or body portion 58. The retaining member 40 may be retained within the cavity 38 by any type of fastening means, including screws or the like. The cavity 38 may be, for example, formed in the body 14 of the stringed musical instrument 12 by being routed or channeled therein. It should be appreciated that other securing means may be utilized as long as it serves the above function, preferably secure, releasable attachment to allow quick changing of the cassette 10.

The retaining member 40 further includes an aperture 41 which allows for the attachment of various jacks or devices to allow the transfer of information, electrical or otherwise therebetween.

The particular material of which the lid 54 and frame 58 are made is not essential to the present invention and may include any number of materials such as molded plastic to provide adequate thickness and to assure durability. Thus, the lid 54 may be formed with a lip 70 curved to conform to the curvature of the guitar for aesthetic purposes. Also, the frame 58 may be formed with a partition 72 running along the middle, and wall members 74 adjacent the front wall 48 to provide reinforcement. In this manner, the wall members 74 may include two tapped holes 76 so that a thumb grip 78 may be fastened to the top of the lid 54 by, for example, screws to facilitate insertion and removal of the pickup cassette 10 from the cavity 38. Further, the four comers of the bottom portion 5 may be molded with extra reinforcement to accommodate tapped holes 80 which align with clearance holes 82 formed in the lid to securely fasten the lid 54 to the frame 58.

The particular pickups 90, illustrated in FIGS. 2, 3, 4, and 5, are secured within each opening 56. The particular pickup is a matter of choice and may include, for example, any of the devices disclosed in U.S. Pat. Nos. 4,616,548 (Anderson), 4,602,547 (Nyack Jr., et al.), 4,351,216 (Hamm) and 4,501,186 (Ikuma), the disclosures of which are hereby incorporated by reference.

In the preferred embodiment, the magnetic pickups 90 are positioned beneath the metal strings 18 to pick up the information provided by the vibrations of the strings 18. The magnetic pickups 90 typically include magnetic cores (not shown) coupled to a permanent magnet and coils wound on the magnetic cores. The winding directions are opposite to each other. Thus, assuming that the string is stationary, no change occurs in the magnetic flux field established by the permanent magnet. When the string vibrates, the magnetic field is thereby modulated, causing an induced signal current to flow in the coils. Accordingly, the magnetic pickups 90 are connected to electrical female jacks 92 and male plugs 94 through which the stringed musical instrument may be connected to an electronic audio amplifier and speaker system or a synthesizer as disclosed, for example, in U.S. Pat. No. 4,357,852 (Suenaga), the disclosure of which is hereby incorporated by reference. The jacks can be any suitable type capable of transmitting information therebetween including wireless or optical devices well known in the art.

Figures 2, 3, 4, 5:
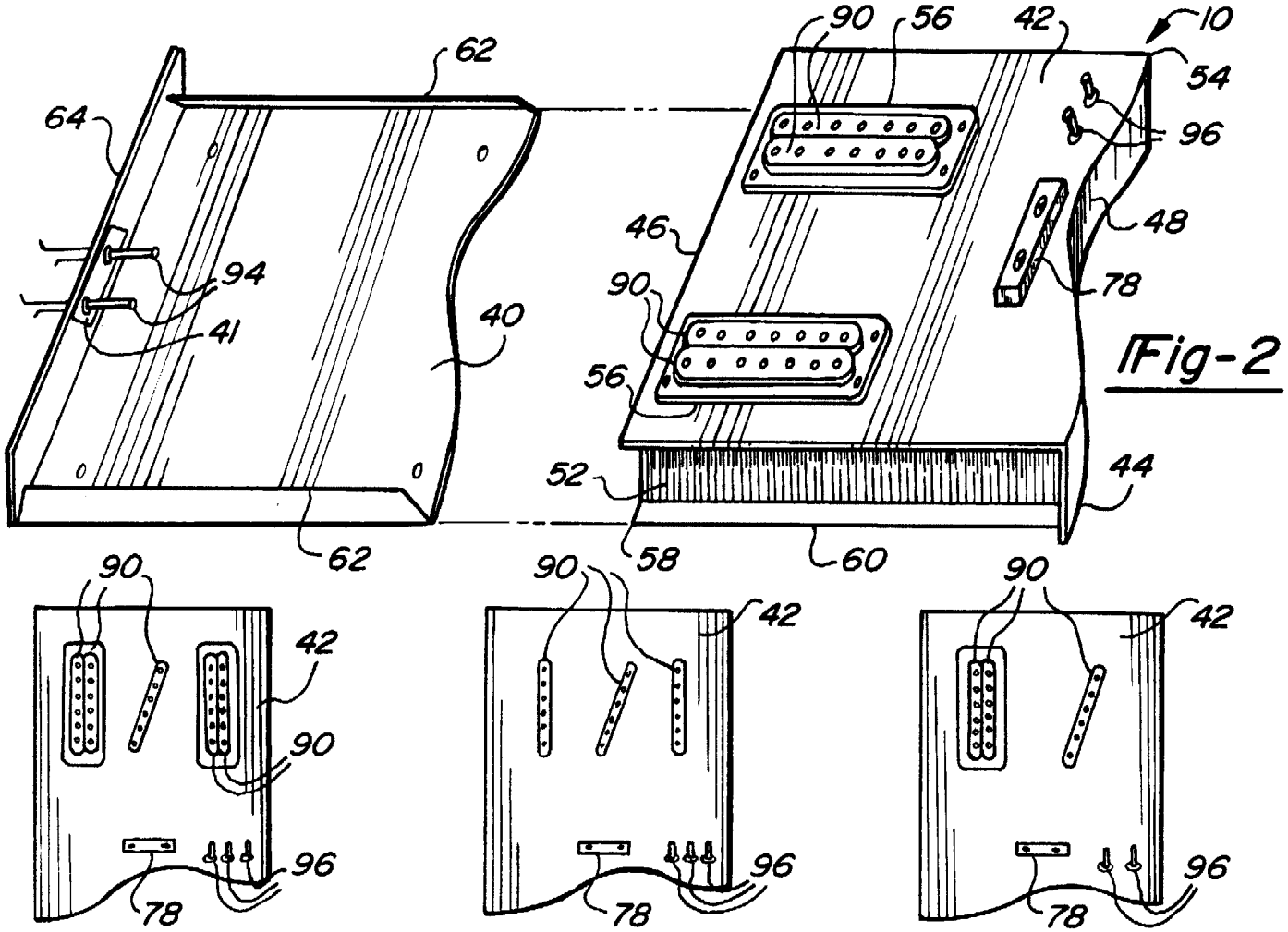
FIG. 2 is an exploded perspective view of the pickup cassette (10) of the present invention, illustrating the details of the retaining member (40) by which the frame (58) of the pickup cassette (10) is retained in a cavity (38) formed in the stringed musical instrument (12)
FIG. 3 is a plan view of an alternative embodiment of the pickup cassette (12) of the present invention illustrating two double and one single magnetic pickups (90), with corresponding switches (96) mounted in a pickup cassette (10)
FIG. 4 is a plan view of an alternative embodiment of the pickup cassette (10), similar to FIG. 3, illustrating three single magnetic pickups (90) with corresponding switches (96) mounted in a pickup cassette (10)
FIG. 5 is a plan view of an alternative embodiment of the pickup cassette (10), similar to that of FIGS. 3 and 4, illustrating one single magnetic pickup (90) and one double magnetic pickup, with corresponding switches (96) mounted in a pickup cassette (10).

The use of the cassette 10 of the present invention with a solid body electric guitar 12 will now be explained. The magnetic pickups 90 typically have a relatively limited angle of pick up, i.e., the devices interact magnetically with a relatively short length of the string 18 directly overlying each magnetic pickup 90 and extending a short distance to either side thereof. As a result, it is common practice to use more than one pickup 90 as illustrated in greater detail in FIGS. 2, 3, 4, and 5. The magnetic pickups 90 are spaced apart from each other along the direction of the strings. Each pickup 90 is positioned for sensing a particular frequency range. For example, as illustrated in FIG. 4, three single pickups 90 might be positioned for optimally responding to bass midrange and treble frequencies. Alternatively, a double pickup 90 and a single pickup 90 may be used as illustrated in FIG. 5, or two double pickups 90 as illustrated in FIG. 3. In addition, the pickups 90 may be provided with switches 96 for selecting any desired combination of pickups 90 together with a volume control 98, as illustrated in FIG. 1, for adjusting the relative output of the pickups. Such switches may include cut out switches to permit change without requiring changing of the instrument, or phase switches or series parallel switches to change the current through the pickups to give a different sound. In this manner, the output of such pickups 90 may be mixed to obtain a desired quality of sound, or to incorporate other components, even batteries.

The cassette 10 of the present invention can also be used alone without the addition of internal components so that an electric guitar can emulate an acoustic guitar by utilizing the cavity 38 for resonance.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

I claim:

1. A cassette (10) free of any musical instrument (12) structure adapted to be inserted into a cavity (38) formed in a body (14) of the musical instrument (12) which is integral in itself, said cavity (38) extending out from one side of said body (14), said musical instrument (12) having a neck (16) extending from one end of said body (14), a fingerboard (28) mounted on said neck (16), and a plurality of strings (18) positioned longitudinally and under tension over said body (14) and said fingerboard (28) and maintained under tension, said cassette (10) comprising a frame having a bottom (44), a pair of side walls (50,52), a back wall (46), and a front wall (48), said cassette (10) having a pair of runners (60), one runner (60) positioned longitudinally along each side of said frame and extending laterally therefrom, a retaining member (40) adapted to be affixed within the cavity (38) of the body (14) of said musical instrument (12), said retaining member (40) having a rear vertical wall (64) and means positioned longitudinally on each side of said retaining member for slidably engaging and retaining the runners (60) of said cassette (10), and said cassette (10) and said retaining member (40) having means for providing a connection therebetween whereby when said retaining member (40) is affixed in the cavity (38) of said musical instrument (12), said cassette (10) is slidably inserted into said retaining member (40).

2. A cassette (10) according to claim 1, wherein said cassette (10) includes at least one pickup member (90) mounted therein for establishing a signal.

3. A cassette (10) according to claim 2, wherein said cassette (10) additionally includes a top cover (42) affixed thereto provided with an opening (56) positioned over said pickup member (90) to permit the signal to pass therethrough.

4. A cassette (10) according to claim 1, wherein said means for providing the connection between said cassette (10) and said retaining member (40) comprises a pair of female electrical jacks (92) and a plurality of male electrical plugs (94) mounted on said cassette (10) and said retaining member (40).

5. A cassette (10) according to claim 1, wherein the front wall (48) of said cassette (10) is formed to conform to the contours of the side wall of said stringed musical instrument (12).

6. A cassette (10) according to claim 1, wherein said retaining member (40) is substantially sheet-form, and is provided with a pair of lateral flanges (62) disposed at an acute angle with respect to the base of said retaining member (40) and converging toward each other, said lateral flanges being spaced apart sufficiently to permit said runners (60) to slide therebetween and to be retained thereby.

7. A cassette (10) according to claim 6, wherein said flanges (62) are disposed at an angle of about 45° with respect to the base of said retaining member.

8. A cassette (10) according to claim 2, wherein at least one switch (96) is interconnected with said pickup means (90).

9. A cassette (10) according to claim 2, wherein said cassette (10) has three single pickup means (90) mounted therein.

10. A cassette (10) according to claim 2, wherein said cassette (10) has two double pickup means (90) mounted therein.

11. A cassette (10) according to claim 1, wherein said cassette (10) has one double and one single pickup means (90) mounted therein.

12. A stringed musical instrument (12) having a body portion (14) including a top (26), bottom, and sides an elongate neck (16) permanently connected at one end to said body portion (14) and at the other end to adjustable string engaging means, a fingerboard (28) mounted on said neck (16), a plurality of strings (18) extending parallel to the longitudinal axis of said musical instrument (12), each attached at one end to said adjustable string engaging means and at the other end to fixed securing means mounted on said body portion, and a bridge (24) supporting said strings (18) in a position spaced above said fingerboard (28) and under tension, a cassette (10) free of any musical instrument (12) structure comprising a frame having a bottom (44), a pair of side walls (50,52), a back wall (46), and a front wall (48), said cassette (10) having a pair of runners (60), one runner (60) positioned longitudinally along each side of said cassette (10) and extending laterally therefrom, a retaining member (40) affixed within the cavity (38) of the body (14) of said musical instrument (12), said retaining member (40) having a rear vertical wall (64) and means positioned longitudinally on each side of said retaining member for slidably engaging and retaining the runners (60) of said cassette (10), and said cassette (10) and said retaining member (40) having means for providing a connection therebetween.

13. A stringed musical instrument (12) according to claim 12, wherein said cassette (10) includes at least one pickup member (90) mounted therein for establishing a signal.

14. A stringed musical instrument (12) according to claim 12, wherein said cassette (10) is slidably inserted into said retaining member (40) and retained therein.

15. A stringed musical instrument (12) according to claim 13, wherein said pickup member (90) is positioned under a portion of said strings (18).

16. A stringed musical instrument (12) according to claim 13, wherein said cassette (10) additionally includes a top cover (42) affixed thereto provided with an opening (56) positioned over said pickup member (90) to permit the signal to pass therethrough.

17. A stringed musical instrument (12) according to claim 12, wherein said means for providing the connection between said cassette (10) and said retaining member (40) comprises a pair of female electrical jacks (92) and a plurality of male electrical plugs (94) mounted on said cassette (10) and said retaining member (40).

18. A stringed musical instrument (12) according to claim 12, wherein the front wall (48) of said cassette (10) is formed to conform to the contours of the side wall of said stringed musical instrument (12).

19. A stringed musical instrument (12) according to claim 12, wherein said retaining member (40) is substantially sheet-form, and is provided with a pair of lateral flanges (62) disposed at an acute angle with respect to the base of said retaining member (40) and converging toward each other, said lateral flanges being spaced apart sufficiently to permit said runners (60) to slide therebetween and to be retained thereby.

20. A stringed musical instrument (12) according to claim 19, wherein said flanges (62) are disposed at an angle of about 45° with respect to the base of said retaining member (40).

21. A stringed musical instrument (12) according to claim 13, wherein at least one switch (96) is interconnected with said pickup means (90).

22. A stringed musical instrument (12) according to claim 13, wherein said cassette (10) has three single pickup means (90) mounted therein.

23. A stringed musical instrument (12) according to claim 13, wherein said cassette (10) has two double pickup means (90) mounted therein.

24. A stringed musical instrument (12) according to claim 13, wherein said cassette (10) has one double and one single pickup means (90) mounted therein.

* * * * *